US006359534B2

(12) United States Patent
Hunter

(10) Patent No.: US 6,359,534 B2
(45) **Date of Patent: *Mar. 19, 2002**

(54) MICROWAVE RESONATOR

(75) Inventor: Ian Charles Hunter, West Yorkshire (GB)

(73) Assignee: Filtronic Plc (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,490

(22) PCT Filed: Nov. 28, 1997

(86) PCT No.: PCT/GB97/03276

§ 371 Date: Jul. 19, 1999

§ 102(e) Date: Jul. 19, 1999

(87) PCT Pub. No.: WO98/25321

PCT Pub. Date: Jun. 11, 1998

(30) Foreign Application Priority Data

Dec. 6, 1996 (GB) ..... 9625416

(51) Int. Cl.[7] ..... H01P 7/10; H01P 1/20
(52) U.S. Cl. ..... 333/219.1; 333/209
(58) Field of Search ..... 333/219.1, 202, 333/209, 206, 207, 208, 210, 212

(56) References Cited

U.S. PATENT DOCUMENTS

| | | | | |
|---|---|---|---|---|
| 2,890,421 A | | 6/1959 | Currie | |
| 4,489,293 A | * | 12/1984 | Fiedziuszko | 333/202 |
| 4,521,746 A | | 6/1985 | Hwan et al. | |
| 5,233,319 A | | 8/1993 | Mizan et al. | |
| 5,638,037 A | * | 6/1997 | Kurisu et al. | 333/202 |
| 6,072,378 A | * | 6/2000 | Kurisu et al. | 333/219.1 |

FOREIGN PATENT DOCUMENTS

| | | |
|---|---|---|
| CH | 552 304 A | 7/1974 |
| DE | 37 06 965 A | 9/1987 |
| EP | 0 064 799 A | 11/1982 |
| EP | 0 432 729 A | 6/1991 |
| GB | 2 284 311 | 5/1995 |
| JP | 59 198003 A | 9/1984 |
| WO | 87 00350 A | 1/1987 |

OTHER PUBLICATIONS

Hunter, et al., "Triple Mode Dielectric Resonator Hybrid Reflection Filters", *IEEP* Aug., 1998.

Patent Abstracts of Japan, vol. 9, No. 56 (E–302) '1779!, Mar. 12, 1985.

Awai I et al., "A Dual Mode Dielectric Waveguide Resonator and Its Application to Bandpass Filters," IEICE Transactions on Electronics, vol. E78–C, No. 8, p. 1018–1025, Aug. 1, 1995.

* cited by examiner

*Primary Examiner*—Robert Pascal
*Assistant Examiner*—Kimberly E Glenn
(74) *Attorney, Agent, or Firm*—Madson & Metcalf

(57) ABSTRACT

A microwave resonator, particularly for use in cellular telecommunications, comprising a hollow electrical conductor defining a resonant cavity and a substantially cubic member located within the cavity. The substantially cubic member has a high dielectric constant compared with the remainder of the cavity.

23 Claims, 3 Drawing Sheets

MICROWAVE RESONATOR

The present invention relates to microwave resonators, and relates particularly, but not exclusively, to microwave resonators for use in cellular telecommunications.

Microwave resonators have a wide range of applications. In particular, in cellular telecommunications, microwave resonators are utilised in microwave filters, multiplexers and power combining networks.

Microwave cavity resonators are known which include an electrically conductive housing which defines a resonant cavity which supports standing waves at microwave frequencies (typically of the order of 1 GHz). It is difficult to construct such known resonators compactly, which is a considerable drawback in the field of cellular communications, in which it is desirable to reduce as much as possible the physical size of apparatus.

Dielectric resonators are known which can be constructed more compactly than the cavity resonators referred to above. Such resonators generally comprise a hollow cylindrical electrical conductor defining a cavity containing a relatively smaller cylindrical dielectric arranged coaxially and symmetrically within the cavity. The resonator has a resonant frequency in the microwave frequency region for signals transmitted in a direction parallel to the cylinder axes.

Preferred embodiments of the present invention seek to provide a dielectric resonator which can be constructed more compactly compared than the prior art resonators described above.

According to the present invention, there is provided a microwave frequency resonator, the resonator comprising a hollow electrical conductor defining a resonant cavity, and a substantially cubic member located within the cavity and having a high dielectric constant compared with the remainder of the cavity.

By providing a substantially cubic member, this has the advantage of enabling the resonant cavity to support resonances corresponding to microwaves travelling in three mutually orthogonal directions (and having the same resonant frequency), i.e. corresponding to microwaves travelling parallel to the sides of the cubic member, as opposed to a single direction in the case of the prior art dielectric resonator referred to above. This in turn provides the advantage that approximately three times as many resonances per unit volume can be obtained than in the case of the prior art dielectric resonator, which enables a particularly compact construction of the resonator.

In a preferred embodiment, the substantially cubic member is constructed from ceramic material and the remainder of the cavity contains air.

The ceramic material may be ZTS.

The resonator preferably further comprises coupling means for coupling together resonant modes of the resonator corresponding to microwaves propagating across the cavity in mutually orthogonal directions.

In a preferred embodiment, the coupling means comprises at least one electrically conducting loop having ends connected to the hollow electrical conductor, wherein the or each loop lies in a respective plane oriented at substantially 45° to an end face of the substantially cubic member.

The resonator may further comprise signal input means for inputting electrical signals into the resonator.

In a preferred embodiment, the connecting means comprises a loop of electrical conductor connected at one end thereof to the hollow electrical conductor and adapted to be connected at the other end thereof to a coaxial cable.

The resonator preferably further comprises tuning means for tuning the or each resonant frequency of the resonator.

The tuning means may comprise at least one tuning member material having a dielectric constant high compared with said remainder of the cavity and adjustment means for adjusting the spacing between the tuning member and the substantially cubic member.

The tuning member may comprise a disk of the same material as the substantially cubic member and connected to the hollow electrical conductor by means of an electrical insulator.

In a preferred embodiment, the cavity is substantially cubic and the substantially cubic member is arranged in the cavity with faces thereof extending substantially parallel to the adjacent faces of the hollow electrical conductor.

The resonator preferably further comprises support means for supporting the substantially cubic member in the cavity.

In a preferred embodiment, the support means comprises a first dielectric member arranged between a face of the substantially cubic member and the adjacent face of the hollow electrical conductor.

The support means preferably further comprises a second support member arranged between a face of the substantially cubic member and the adjacent face of the hollow electrical conductor and on an opposite side of the substantially cubic member to the first support member.

The support means may further comprise urging means for placing the substantially cubic member under compression between the first and second support members.

The first and/or second support members are preferably formed substantially from alumina.

According to another aspect of the invention, there is provided a microwave frequency bandpass filter, the filter comprising signal input means for inputting electrical signals into the filter, signal output means for outputting electrical signals from the filter, and at least one resonator as defined above connected between the signal input means and the signal output means.

The filter may comprise a plurality of said resonators electrically coupled together.

According to a further aspect of the invention, there is provided a microwave frequency bandstop filter, the filter comprising a 3 dB hybrid, and a bandpass filter as defined above connected between a first pair of terminals of the hybrid such that the transmission response between a second pair of terminals of the hybrid represents the reflection coefficient of the bandpass filter.

In a preferred embodiment, an even mode impedance of the bandpass filter is connected to one terminal of said first pair and an odd mode impedance of the bandpass filter is connected to the other terminal of said first pair.

The hybrid may comprise a microstrip coupler.

According to a further aspect of the invention, there is provided a microwave frequency power combiner, the combiner comprising amplifier means for inputting a plurality of electrical signals at different frequencies into at least one resonator as defined above, and output means for outputting electrical signals from the or each resonator to a microwave frequency antenna.

As an aid to understanding the invention, preferred embodiments thereof will now be described, by way of example only and not in any limitative sense, with reference to the accompanying drawings, in which.

Figure 5A:
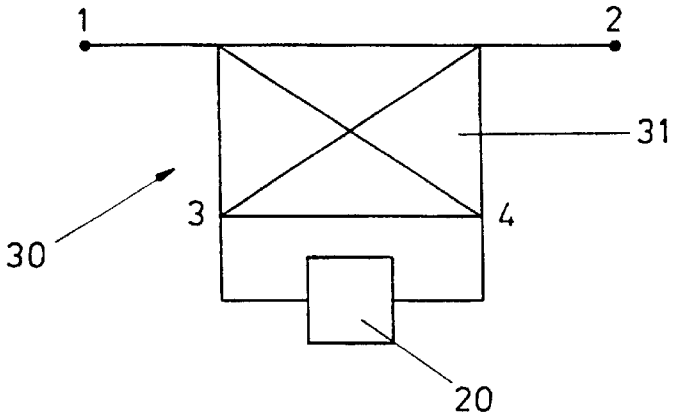
Figure 5B:
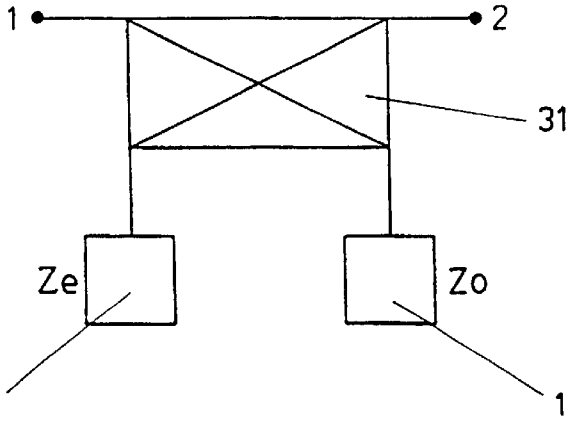
Figure 6:
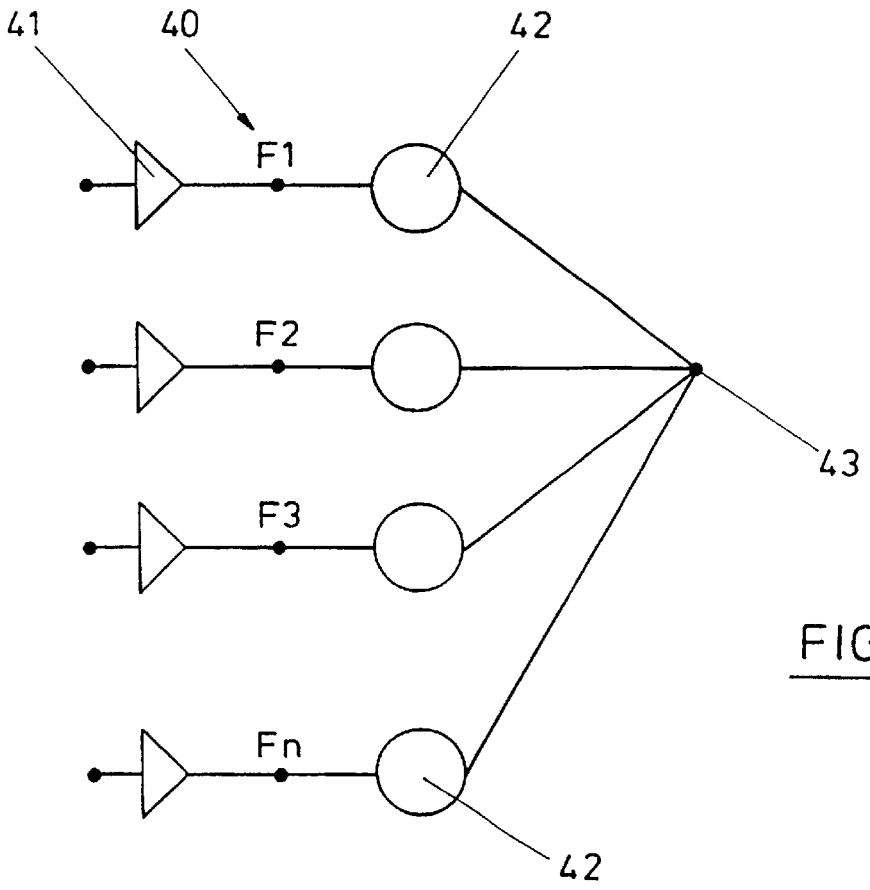

FIG. 5*a* is a schematic representation of a first embodiment of a bandstop filter embodying the present invention;

FIG. 5*b* is a schematic representation of a second embodiment of a bandstop filter embodying the present invention;

FIG. 6 is a schematic representation of a conventional power combiner; and

Figure 7:
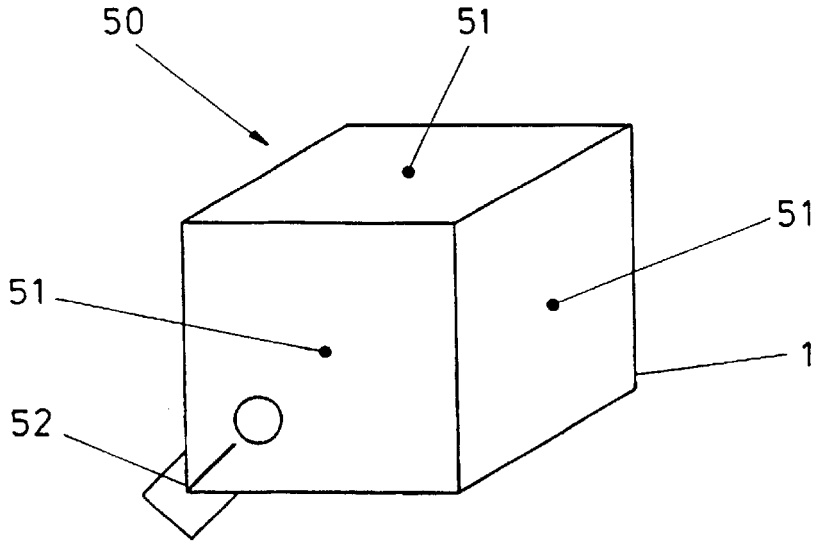

FIG. 7 is a schematic representation of a power combiner embodying the present invention.

Figure 1:
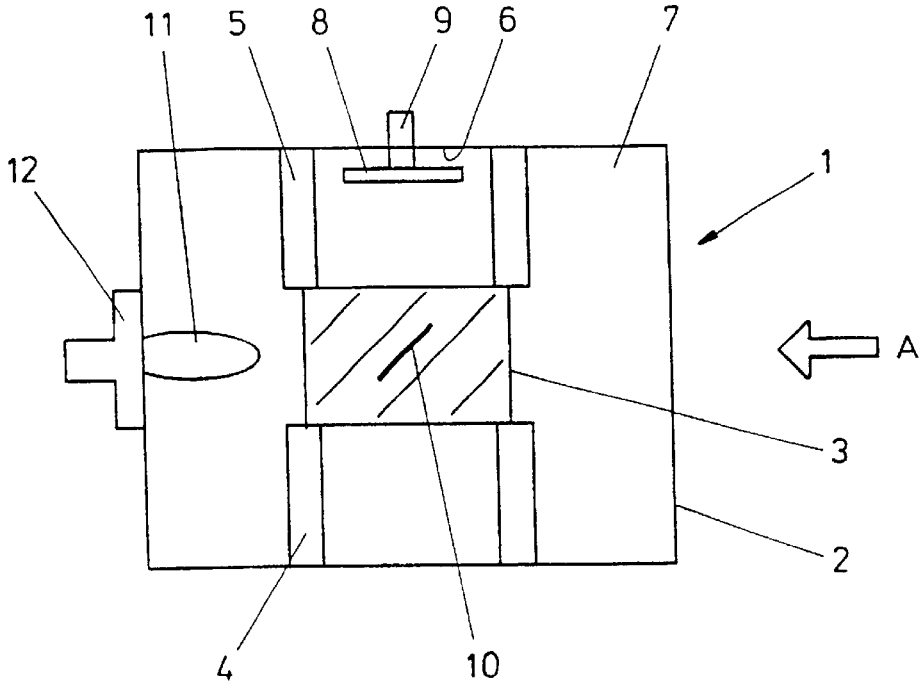
FIG. 1 is a schematic elevation view of a dielectric microwave resonator embodying the present invention.

Referring to FIG. 1, a dielectric microwave resonator 1 comprises a generally cubic hollow electrical conductor 2 of side length 115 mm and defining a resonant cavity. A generally cubic member 3 of low loss high dielectric constant ceramic material ZTS of side length 52 mm is arranged within the cavity such that the faces of the cubic member 3 are generally parallel to the adjacent faces of the hollow conductor 2. As will be appreciated by persons skilled in the art, ZTS has a dielectric constant of approximately $\epsilon_R$=40 and a loss tangent of approximately tan $\delta=4\times10^{-5}$ at a frequency of 900 MHz.

The cubic member 3 is supported by a lower hollow cylinder 4 of alumina, which typically has a dielectric constant of approximately 10, and an upper hollow cylinder 5 of alumina and a spring washer 6 are arranged between an upper face of the cubic member 3 and the top of the cavity such that the spring washer 6 is placed under compression by the upper surface 7 of the conductor 2, the upper surface 7 acting as a removable lid. The hollow cylinders 4, 5 are provided with indents (not shown) which co-operate with corresponding projections on the internal faces of the hollow conductor 2 in order to assist in correctly orienting the cubic member 3 in the cavity such that the faces of the cubic member 3 extend parallel to the adjacent faces of the hollow conductor 2.

A disk 8 of ZTS is mounted to the upper face 7 of the hollow conductor 2 by means of an electrically insulating screw 9 of plastics material such that the spacing d between the disk 9 and the upper face of the cubic member 3 can be adjusted. This in turn enables the resonant frequency of the resonator 1 to be adjusted.

The resonator 1 supports three resonances, corresponding to microwaves traversing the cavity in three mutually orthogonal directions generally parallel to each side of the hollow conductor 2 and cubic member 3. In order to couple the three resonances together, one or more wire loops 10 are attached to a respective internal surface of the conductor 2 and extends in a respective plane generally normal to the surface. Each of the loops 10 is arranged at an angle of approximately 45° to the internal surfaces of the conductor 2 which are normal to the surface to which the loop 10 is attached. The ends of each loop 10 are connected to the surface of the hollow conductor 2, which is grounded.

A further wire loop 11 is connected at one end to a co-axial connector 12 and at the other end to the grounded metallic housing 2 of the cavity in order to enable signals to be input into the resonator 1 by means of the loop 11 coupling into the magnetic field inside the cavity.

The operation of the resonator shown in FIGS. 1 and 2 will now be explained with reference to FIG. 3. An approximate explanation of the operation of the resonator can be provided by considering microwave propagation in a direction parallel to one of the faces of the cubic member 3 (e.g the z direction) . Because of the symmetrical construction of the resonator 1, identical behaviour is observed in the x and y directions.

It is assumed that the transverse boundary condition to the dielectric forming the cubic member 3 is a perfect magnetic conductor surrounding the dielectric. This assumption is possible because of the large change in dielectric constant at the air/dielectric interface at the face of the cubic member 3. As a result, it can be assumed that for signals propagating in the z direction the dielectric region may be represented as a dielectric waveguide of square cross section in which signals are propagating (i.e. are above cut off). Outside of the dielectric region, the fields will be evanescent (i.e. cut off) as a result of the absence of dielectric and the magnetic walls may be extended to the hollow conductor 2. The regions outside of the dielectric member 3 may therefore be represented as sections of cut off square waveguide terminated in short circuits as shown in FIG. 3. This equivalent circuit can be readily analyzed.

Accordingly, as will be appreciated by persons skilled in the art, for a TE mode within the dielectric region, since the boundary condition is that of a perfect magnetic conductor, the tangential magnetic field at the edge of the dielectric will be zero. As a result $$H_z = \cos\left(\frac{m\pi x}{l}\right)\cos\left(\frac{n\pi y}{l}\right)$$

The lowest propagating mode is the TE11 mode, and the propagation constant inside the dielectric region is given by $$\gamma=j\beta \text{ and } \beta=\sqrt{[\omega^2\mu_0\epsilon_0\epsilon_R-2(\pi)^2]} \qquad 1$$

and outside of the dielectric region the propagation constant is given by $$\gamma=\alpha=\sqrt{[2(\pi)^2-\omega^2\mu_0\epsilon_0]} \qquad 1$$

the characteristic impedance inside the dielectric region is given by $$Zo = \frac{j\omega\mu}{l} = \frac{\omega\mu}{\beta}$$

and outside of the dielectric region is given by $$Zo = \frac{j\omega\mu}{\alpha}$$

Analysing this arrangement for resonance gives the condition $$\frac{\beta}{\alpha}\tan\left(\frac{\beta l}{2}\right)\Big/\tanh(\alpha l) = 1$$

This is the resonance equation for a TE11 delta mode resonance and may be solved given 1,1, $\epsilon_R$ and $\gamma$ from the previous equations.

The resonator 1 having the dimensions described above with reference to FIGS. 1 and 2 supports three resonances at 850 MHz, each of which has a Q value of 25000. Accordingly, the resonator 1 described above can be constructed in a much more compact manner than a prior art dielectric resonator having similar performance.

Figure 2:
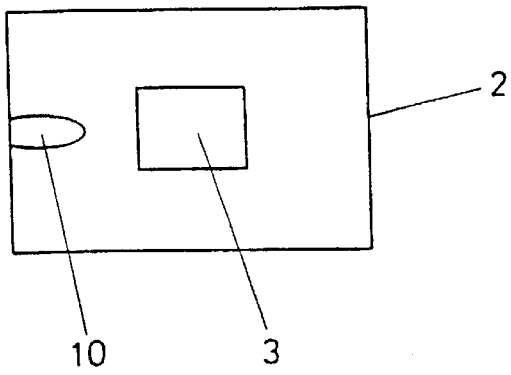
FIG. 2 is a schematic elevation view of the resonator of FIG. 1 in the direction of arrow A in FIG. 1.
Figure 3:
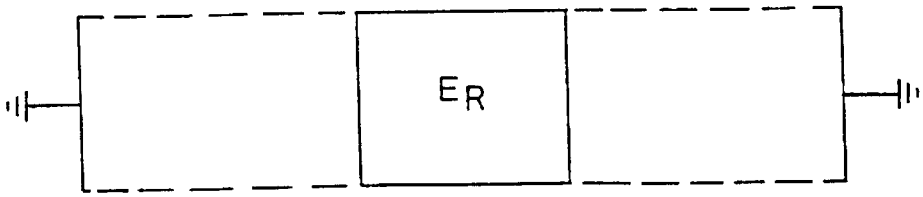
FIG. 3 is a schematic representation of an approximate equivalent circuit to the resonator of FIGS. 1 and 2.
Figure 4:
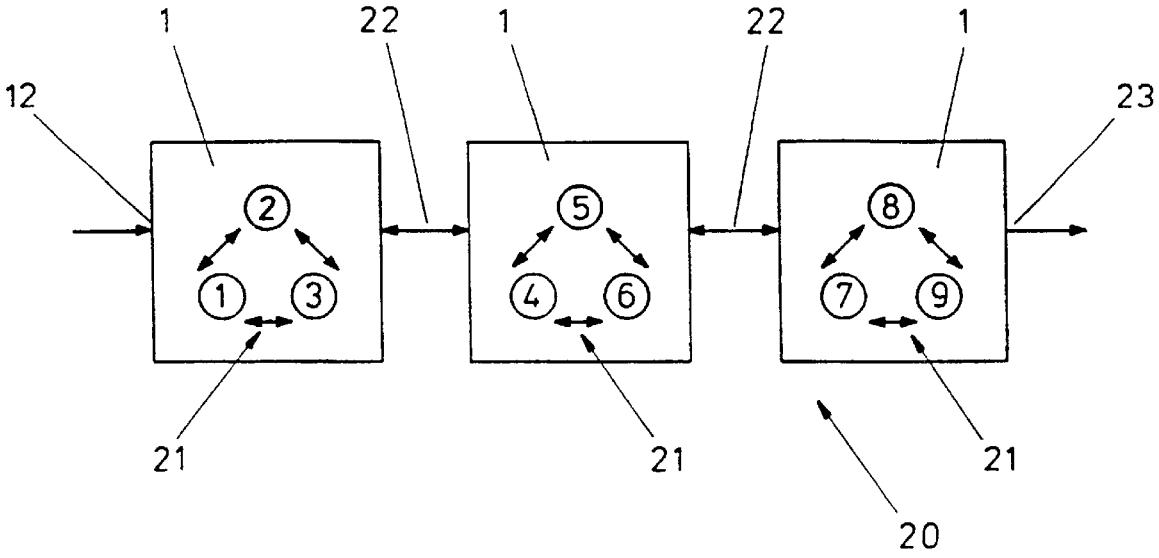
FIG. 4 is a schematic representation of a bandpass filter embodying the present invention.

Referring now to FIG. 4, in which parts common to the embodiment of FIGS. 1 to 3 are denoted by like reference numerals, a band pass filter 20 is constructed from a cascade of triplets of resonators 21. Each of the triplets 21 of interconnected resonators is realised using a resonator 1 of the embodiment of FIGS. 1 to 3 and is in effect a 3rd degree ladder network having a single non-adjacent resonator coupling.

The non-adjacent coupling enables a transmission zero to be placed on each side of the filter passband.

The filter 20 is formed by cascading the resonators 1 together by means of couplings 22 which couple a single mode in one resonator 1 to another mode in a different resonator 1. The filter 20 is also provided with an input coupling 12, which may be a coaxial coupling as in the embodiment of FIGS. 1 to 3, and an output coupling 23.

FIG. 5*a* shows a bandstop filter 30 comprising a four terminal 3 dB 90 degree hybrid 31, which may be a conventional branch line microstrip coupler. A bandpass filter 20 as shown in FIG. 4 is connected across ports 3 and 4 of the hybrid 31, and the transmission response between ports 1 and 2 of the hybrid 31 then represents the reflection coefficient of the bandpass filter 20 so that a bandstop filter response is achieved.

Referring to FIG. 5*b*, the bandstop filter 30 of FIG. 5*a* is simplified by connecting the even mode impedance of the bandpass filter 20 to port 3 of the hybrid 31 and the odd mode impedance of the bandpass filter 20 to port 4. For example, for a 6th degree network Ze and Zo (representing the even and odd modes respectively) will be triple mode resonators 1 as described with reference to FIGS. 1 to 3 and tuned to produce the even or odd mode input impedance.

FIG. 6 shows a conventional microwave power combiner, a typical application of which is to add the outputs from power amplifiers 41 via respective resonators 42 into a common antenna port 43. As will be appreciated by persons skilled in the art, each amplifier 41 is required to output signals of a different carrier wave frequency F1 to Fn, and the combiner 40 is therefore required to have isolation between channels. Single mode resonators 42 are usually utilised for this purpose, and since in the field of cellular communications such combiners may have up to 30 channels, the physical size of the combiner 40 tends to be large.

Referring now to FIG. 7, which shows a microwave power combiner 50 embodying the present invention, groups of three resonators 42 of the arrangement of FIG. 6 are replaced by respective resonators 1 of the embodiment of FIGS. 1 to 3. Input connectors 51 are provided on three orthogonal faces of the resonator 1. An output connector 52 is provided at a corner of the resonant cavity (where threefold symmetry exists and where each mode may therefore be combined equally) from which output signals can be taken from the combiner 50. As a result, an approximately threefold reduction in physical size of the combiner 50 is achieved compared with the combiner 40 of FIG. 6.

It will be appreciated by persons skilled in the art that the above embodiment has been described by way of example only and not in any limitative sense, and that various alterations and modifications are possible without departure from the scope of the invention as defined by the appended claims.

What is claimed is:

1. A microwave frequency resonator, the resonator comprising a hollow electrical conductor defining a resonant cavity, and a substantially cubic member located within the cavity and having a high dielectric constant compared with the remainder of the cavity, such that in use the resonator supports three mutually orthogonal resonances having the same resonant frequency.

2. A resonator according to claim 1, wherein the substantially cubic member is constructed from ceramic material and the remainder of the cavity contains air.

3. A resonator according to claim 2, wherein the ceramic material is ZTS.

4. A resonator according to claim 1, further comprising coupling means for coupling together resonant modes of the resonator corresponding to microwaves propagating across the cavity in mutually orthogonal directions.

5. A resonator according to claim 1, further comprising signal input means for inputting electrical signals into the resonator.

6. A resonator according to claim 5, wherein the connecting means comprises a loop of electrical conductor connected at one end thereof to the hollow electrical conductor and adapted to be connected at the other end thereof to a coaxial cable.

7. A resonator according to claim 1, further comprising tuning means for tuning the or each resonant frequency of the resonator.

8. A resonator according to claim 7, wherein the tuning means comprises at least one tuning member material having a dielectric constant high compared with said remainder of the cavity and adjustment means for adjusting the spacing between the tuning member and the substantially cubic member.

9. A resonator according to claim 1, wherein the cavity is substantially cubic and the substantially cubic member is arranged in the cavity with faces thereof extending substantially parallel to the adjacent faces of the hollow electrical conductor.

10. A resonator according to claim 1, further comprising support means for supporting the substantially cubic member in the cavity.

11. A microwave frequency bandpass filter, the filter comprising signal input means for inputting electrical signals into the filter, signal output means for outputting electrical signals from the filter, and at least one resonator according to claim 1 connected between the signal input means and the signal output means.

12. A filter according to claim 11, comprising a plurality of said resonators electrically coupled together.

13. A resonator according to claim 1, wherein the resonator is configured to sustain a TE11 delta mode resonance.

14. A microwave frequency resonator, the resonator comprising:

a hollow electrical conductor defining a resonator cavity;

a substantially cubic member located within the cavity and having a high dielectric constant compared with the remainder of the cavity; and coupling means for coupling together resonant modes of the resonator corresponding to microwaves propagating across the cavity in mutually orthogonal directions, wherein the coupling means comprises at least one electrically conducting loop having ends connected to the hollow electrical conductor, wherein the or each loop lies in a respective plane oriented at substantially 45° to an end face of the substantially cubic member.

15. A microwave frequency resonator, the resonator comprising:

a hollow electrical conductor defining a resonant cavity:

a substantially cubic member located within the cavity and having a high dielectric constant compared with the remainder of the cavity, tuning means for tuning the or each resonant frequency of the resonator, wherein the tuning means comprises at least one tuning member material having a high dielectric constant compared with said remainder of the cavity, wherein the tuning member comprises a disk of the same material as the substantially cubic member and connected to the hollow electrical conductor by means of an electrical insulator: and adjustment means for adjusting the spacing between the tuning member and the substantially cubic member.

16. A microwave frequency resonator, the resonator comprising:

a hollow electrical conductor defining a resonant cavity;

a substantially cubic member located within the cavity and having a high dielectric constant compared with the remainder of the cavity; and support means for supporting the substantially cubic member in the cavity, wherein the support means comprises a first dielectric member arranged between a face of the substantially cubic member and the adjacent face of the hollow electrical conductor.

17. A resonator according to claim 16, wherein the support means further comprises a second support member arranged between a face of the substantially cubic member and the adjacent face of the hollow electrical conductor and on an opposite side of the substantially cubic member to the first support member.

18. A resonator according to claim 17, wherein the support means further comprises urging means for placing the substantially cubic member under compression between the first and second support members.

19. A resonator according to claim 16, wherein the first and/or second support members are formed substantially from alumina.

20. A microwave frequency bandstop filter, the bandstop filter comprising:

a 3 dB hybrid; and a bandpass filter connected between a first pair of terminals of the hybrid such that the transmission response between a second pair of terminals of the hybrid represents the reflection coefficient of the bandpass filter, the bandpass filter comprising:

signal input means for inputting electrical signals into the bandpass filter;

signal output means for outputting electrical signals from the filter; and at least one microwave frequency resonator, the resonator comprising:

a hollow electrical conductor defining a resonant cavity; and a substantially cubic member located within the cavity and having a high dielectric constant compared with the remainder of the resonant cavity.

21. A filter according to claim 20, wherein an even mode impedance of the bandpass filter is connected to one terminal of said first pair and an odd mode impedance of the bandpass filter is connected to the other terminal of said first pair.

22. A filter according to claim 20, wherein the hybrid comprises a microstrip coupler.

23. A microwave frequency power combiner, the combiner comprising:

amplifier means for inputting a plurality of electrical signals at different frequencies into at least one microwave frequency resonator, the resonator comprising a hollow electrical conductor defining a resonant cavity, and a substantially cubic member located within the cavity and having a high dielectric constant compared with the remainder of the cavity; and output means for outputting electrical signals from the or each resonator to a microwave frequency antenna.

* * * * *